United States Patent [19]

Takeuchi et al.

[11] Patent Number: 4,841,328

[45] Date of Patent: Jun. 20, 1989

[54] ELECTROSTATIC RECORDING APPARATUS

[75] Inventors: Masaru Takeuchi; Takeo Fukatsu, both of Kyoto; Shoichi Nakano, Osaka; Yukinori Kuwano, Osaka; Koji Minami, Osaka; Masayuki Iwamoto, Hyogo, all of Japan

[73] Assignee: Sanyo Electric Co., Ltd., Japan

[21] Appl. No.: 893,099

[22] Filed: Aug. 4, 1986

[51] Int. Cl.[4] ..... G03G 15/00

[52] U.S. Cl. ..... 355/211; 355/210; 430/31; 430/58; 430/95

[58] Field of Search ..... 430/84, 95, 31, 58; 355/3 DR

[56] References Cited

U.S. PATENT DOCUMENTS

| | | | |
|---|---|---|---|
| 3,594,160 | 7/1971 | Gunto et al. | 430/31 |
| 4,460,669 | 1/1984 | Ogawa et al. | 430/84 |
| 4,623,243 | 11/1986 | Iijima | 355/15 |

*Primary Examiner*—J. David Welsh

*Attorney, Agent, or Firm*—Darby & Darby

[57] ABSTRACT

An electrostatic recording apparatus comprises a photosensitive drum. The photosensitive drum comprises a bulk layer of amorphous silicon formed on a support, and in the bulk layer, a first layer region is formed at the support side and a second layer region is formed at the surface side. The first layer region is formed in a manner of comprising hydrogen of 0.01–40 atomic %, oxygen of 0.1–40 atomic % and boron of $5\times10^{-6}$-1.0 atomic %. On the other hand, oxygen and boron are not doped virtually in the second layer region and generation of carrier traps is suppressed in this non-doped second layer region. Furthermore, the peak wavelengths of the lights irradiated onto the photosensitive drum from both a light source for exposure and light source for discharge are set shorter than 650 nm, and preferably shorter than 600 nm. Light of short wavelengths shorter than 650 nm is almost absorbed in the second layer region, and generation of carriers in the first layer region is small, and thereby capture of carriers in traps is suppressed.

33 Claims, 3 Drawing Sheets

ELECTROSTATIC RECORDING APPARATUS

BACKGROUND OF THE INVENTION

1. Field of the Invention

The present invention relates to an electrostatic recording apparatus. More specifically, the present invention relates to an electrostatic recording apparatus which employs a photosensitive member composed of amorphous silicon.

2. Description of the Prior Art

For example, in the U.S. Pat. No. 4,460,669 issued on July 17, 1984, a photosensitive member using amorphous silicon is disclosed and this photosensitive member comprises a bulk layer of amorphous silicon formed on a support. Oxygen, carbon or nitrogen is doped in this bulk layer together with an element or atom belonging to the group III of the periodic table such as boron. Then, the uppermost layer region, that is, the surface layer region of the bulk layer is formed as a so-called non-doped layer wherein any of oxygen, carbon and nitrogen and any of elements in the group III is not doped.

The photosensitive member disclosed in this U.S. Pat. No. 4,460,669 is, presumed to improve the charging property. This is because the surface layer region, that is, the non-doped layer region is formed in the bulk layer, so carrier traps are not generated which are generated in the vicinity of the surface of the conventional photosensitive member having no non-doped layer and therefore the charing property will be improved.

On the other hand, in the electrostatic recording apparatus, generally light is irradiated to expose the photosensitive member and to eliminate the residual charges of the photosensitive member. For light sources for these purposes, for example, halogen lamps or the like are utilized. The halogen lamp has a wide range of luminous spectrum and the peak wave length is about more than 700 nm. Even if the improved photosensitive member disclosed in the U.S. Pat. No. 4,460,669 as cited previously is employed, when such a light source having the same range of wavelengths as that of the conventional one is used, light from this light source is transmitted through the surface layer of the photosensitive member and plunges into the bulk layer, and a large number of carriers are produced in the bulk layer likewise the convention cases, and the carriers are caught in traps. This means that even if the photosensitive member is employed wherein the non-doped layer is formed on the surface of the bulk layer, when light sources for exposure and discharge of long wavelengths like the conventional ones are used, resultingly, a sufficient improvement in the charging property is not achieved.

SUMMARY OF THE INVENTION

Therefore, a principal object of the present invention is to provide an electrostatic recording apparatus which can still further improve the charging property.

Another object of the present invention is to provide an electrostatic recording apparatus in which the charging property can be improved by uniquely combining a structure of a photosensitive member with the wavelength of light irradiated onto the photosensitive member.

Still another object of the present invention is to provide an electrostatic recording apparatus where so-called "unstationary image" fault fails to take place even when the photosensitive member is employed wherein the non-doped layer region is formed on the surface of the bulk layer.

To be brief, the present invention is of an electrostatic recording apparatus which employs such a photosensitive member that a bulk layer of amorphous silicon is formed on a support, and a first layer region is formed at the support side in the bulk layer and a second layer region is formed at the surface side therein, and oxygen (or carbon or nitrogen) and a dopant of an element in the group III of the periodic table such as boron (or an element in the group V such as phosphorus) are doped in the first layer region, and these elements are not doped virtually in the second layer region, and at the same time sets the wavelengths of light irradiated onto the photosensitive member shorter than 650 nm, and preferably shorter than 600 nm.

Generation of carrier traps in the vicinity of the surface of the photosensitive member is suppressed by the second layer region or non-doped layer region formed in the bulk layer thereof. Also, the wavelengths of light irradiated onto the photosensitive member are short in comparison with those of the conventional apparatuses, and therefore such a light scarcely reaches the first layer region in the bulk layer, and accordingly generation of carrier traps in the bulk layer is also suppressed. Thus, the charging property of the photosensitive member is improved in comparison with the convention apparatuses.

Light having wavelengths shorter than 650 nm, and preferably shorter than 600 nm is obtainable by combining a halogen lamp, tungsten lamp, fluorescent lamp, fuse lamp or a mercury lamp with a cut filter. Also, such a light is obtainable also by an LED of orange, yellow, green or blue color.

These objects and other objects, features, aspects and advantages of the present invention will become more apparent from the following detailed description of the embodiments of the present invention when taken in conjunction with accompanying drawings.

DESCRIPTION OF THE PREFERRED EMBODIMENTS

Figure 1:
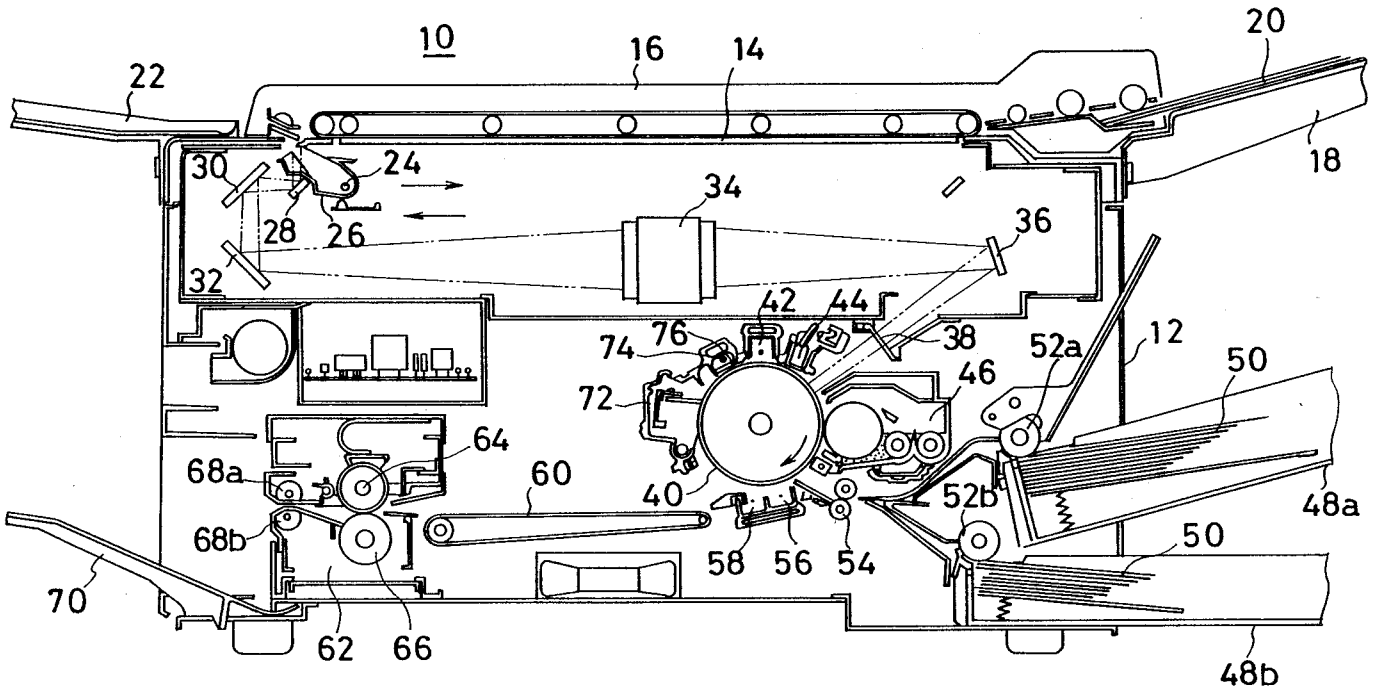
FIG. 1 is an illustrative inner structure view showing a structure of one embodiment in accordance with the present invention.

Description is made on an electrophotographic copying machine as one embodiment in accordance with the present invention reference to FIG. 1. It is pointed out in advance that the present invention is applicable to all electrostatic recording apparatuses such as printers, facsimiles and others in addition to such an electrophotographic copying machine.

An electrophotographic copying machine 10 comprises a main unit 12, and an original table 14 composed of a transparent glass plate is installed in a fixed fashion on the top surface of this main unit 12. An automatic document feeder 16 is mounted on the top of this original table 14. An original stacking table 18 storing originals 20 before copying is installed at the starting side of the automatic document feeder 16, and a tray 22 for receiving the originals is installed at the ending side of the automatic document feeder 16.

Under the original table 14 of the electrophotographic copying machine main unit 12, an exposure lamp 24 for exposing the original is installed, and this exposure lamp 24 is constituted in a manner capable of moving reciprocatively between one end and the other end of the original table 14 as shown by arrows. In a light source for exposure, a reflecting mirror 16 having an elliptic cross-section is installed, and a first movable mirror 28 is fixed to this reflecting mirror 26. Attending on a movement of the exposure lamp 24, this first movable mirror 28 moves likewise, and an original image reflected by this first movable mirror 28 is reflected again by a pair of movable mirrors 30 and 32, plunging into a zoom lens 34. The original image passing through the zoom lens 34 plunges into a fixed mirror 36 disposed in front thereof. The original image passing through the fixed reflecting mirror 36 goes through a cut filter 38, forming an image on the exposure position of a photosensitive drum 40.

In this embodiment, a halogen lamp is employed for the exposure lamp 24. The peak wavelength of the halogen lamp is longer than 700 nm. In this embodiment, the light from this exposure lamp 24 is not made to plunge intact into the photosensitive drum 40. The cut filter 38 is installed for this purpose, and this cut filter 38 cuts off the long-wavelength region of the light, specifically, the portion of wavelengths longer than 650 nm of the light from the exposure lamp 24. Accordingly, in this embodiment, the light of wavelengths shorter than 650 nm plunges into the photosensitive drum 40 to exposure the original image.

Meanwhile, the experiments conducted by the present inventors showed good results enough for practical application by setting the wavelengths of the exposure light irradiated onto the photosensitive drum 40 shorter than 650 nm. However, the wavelengths of the exposure light is set more preferably shorter than 600 nm.

A charging corotron 42 is installed upstream from the exposure position of the photosensitive drum 40, that is, the position whereon the light coming through the cut filter 38 is irradiated, and this charging corotron 42 charges uniformly a surface of the photosensitive drum 40 to be rotated in a specific polarity. A side eraser 44 is installed between the charging corotron 42 and the exposure position, and this side eraser 44 eliminates charges of the portion corresponding to the fringe of paper sheet on the photosensitive drum 40. Then, on the surface of the photosensitive drum 40 passing through the side eraser 44, an electrostatic latent image equivalent to the original 20 is formed by light wavelengths shorter than 650 nm irradiated through the cut filter 38.

The electrostatic latent image formed on the photosensitive drum 40 is developed with toner by a developing device 46 installed downstream from the exposure position Paper feed cassettes 48*a* and 48*b* are provided at one end of the main unit 12, and paper sheets 50 are stored in a stack in the respective paper feed cassettes 48*a* and 48*b*. The paper sheets 50 stored in the paper feed cassettes 48*a* and 48*b* are taken out by feeder rollers 52*a* and 52*b*, being sent to a register roller 54. Meanwhile, needless to say, the paper sheets 50 are not taken out simultaneously from both of the paper feed cassettes 48*a* and 48*b*, being fed from one paper feed cassette selected by the operator.

The paper sheet timing-adjusted by the register roller 54 is fed in the vicinity of the photosensitive member 40, and a toner image developed by the developing device 46 is transferred onto the paper sheet by a transferring corotron 56. A separating corotron 58 is installed downstream from the transferring corotron 58. The paper sheet separated by the separating corotron 58 is sent to a fixing device 62 by a vacuum conveyer 60. The fixing device 62 comprises a heating roller 64 and a pressing roller 66, fixing the toner image formed on the surface thereof by heating. The paper sheet whereon the toner image is fixed is discharged onto the copy receiving tray 70 by paper discharging rollers 68*a* and 68*b*.

A cleaning device 72 is installed downstream from the transferring corotron 56 and accordingly the separating corotron 58 along the surface of the photosensitive drum 40, and this cleaning device 72 removes the toner remaining on the photosensitive drum 40 after transfer.

An eraser 74 for eliminating the charges remaining on the photosensitive drum 40 is installed downstream from the cleaning device 72 and upstream from the charging corotron 42. This eraser 74 is constituted, for example, by a tungsten lamp. In general, the tungsten lamp has a peak wavelength of 700 nm or more. In this embodiment, the light from this tungsten lamp is not irradiated intact onto the photosensitive drum 40. For this purpose, a cut filter 76 is disposed in front of the eraser 74. This cut filter 76, likewise the previous cut filter 38, cuts off the component of long wavelengths, that is, the region of wavelengths longer than 650 nm comprised in the light from the tungsten lamp 74. Accordingly, the light of wavelengths shorter than 650 nm is irradiated onto the photosensitive drum 40.

Meanwhile, the experiments conducted by the present inventors showed good results enough for practical application by setting the wavelengths of the light for discharging irradiated onto the photosensitive drum 40 shorter than 650 nm. However, the wavelengths of the light discharging is further preferably set shorter than 600 nm.

Figure 2:
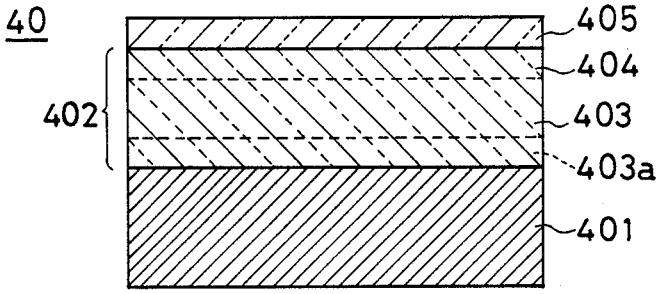
FIG. 2 is a schematic view for showing a structure of a photosensitive drum.

In reference to FIG. 2, the photosensitive drum 40 comprises a support 401 composed of a conductive material, for example, aluminum, and a bulk layer 402 of amorphous silicon is formed on this support 401. In the bulk layer of amorphous silicon 402, a first layer region 403 is formed at the support 401 side, and a second layer region 404 is formed at the surface side. Then, a surface protecting layer 405 is formed on the second layer region 404, that is, on the bulk layer 402.

The first layer region 403 comprised in the bulk layer 402 is formed in a manner that silicon atoms are base material and hydrogen of 0.01–40 atomic %, oxygen of 0.1–40 atomic % and boron of $5\times10^{-6}$–1.0 atomic % are added. Then the thickness of this first layer region 403 is 1–50 μm, more preferably 3–40 μm and most preferably 5–30 μm.

Elements such as oxygen and boron contained in the first layer region 403 are not doped in the second layer region 404. This means that, the second layer region 404 is formed in a manner that silicon atoms are base material and hydrogen of 0.01–40 atomic % is added, and adjustment is made so that oxygen is less than 1000 atomic ppm and boron is less than 5 atomic ppm. Such amounts of addition of oxygen and boron mean that these elements are not doped virtually, and accordingly, the second layer region 404 is formed as a non-doped layer. In addition, the thickness of the second layer region 404 is 0.05–20 μm, more preferably 0.2–10 μm and most preferably 1–5 μm.

Specific elements added in the bulk layer 402 of the photosensitive member drum 40 and the profiles of concentration thereof may be the same or similar to those of the U.S. Pat. No. 4,460,669 as previously cited. Accordingly, detailed description on the specific method of forming such a bulk layer 402 of amorphous silicon is omitted here.

Also, a carrier injection blocking layer 403*a* may be formed in the first layer region 403 at the support side of the bulk layer 402. This carrier injection blocking layer 403*a* is formed, like the other layer regions of the bulk layer 402, in a manner that amorphous silicon is the main component, and oxygen of $1\times10^{-3}$–8.0 atomic %, nitrogen of $1\times10^{-4}$–6.0 atomic % and boron of $1\times10^{-3}$–0.5 atomic % are doped. The thickness of the carrier injection blocking layer 403*a* is 0.1–10 μm, and more preferably 0.5–5 μm.

The surface protecting layer 405 formed on the non-doped layer 404 uses an amorphous material expressed by a chemical formula, a-$Si_aN_{1-a}$($0.1\leqq a\leqq0.999$) or a-$(Si_bN_{1-b})_cH_{1-c}$($0.1\leqq b\leqq0.999$) ($0.5\leqq c\leqq0.999$). However, for this surface protecting layer 405, an amorphous material expressed by a chemical formula, a-$Si_aC_{1-a}$($0.1\leqq a\leqq0.999$) or a-$(Si_bC_{1-b})_cH_{1-c}$ ($0.5\leqq c\leqq0.999$) may be used.

Carrier traps in the bulk layer 402 constituting the photosensitive drum 40 can be decreased by employing the photosensitive drum 40 of such a structure. To be detailed, normal amorphous silicon has a small dark resistance, and therefore an improvement in the charging property can be expected by adding a small amount of oxygen and/or boron like the first layer region 403 of the bulk layer 402. However, these oxygen and/or boron act as carrier traps in the bulk layer 402. Then, the first layer region 403 doped with oxygen and/or boron to obtain a large dark resistance and the second layer region 404 not doped with oxygen and boron to prevent deterioration of the charging property by the reverse polarity carriers released from carrier traps in charging are formed, and thereby generation of carrier traps in the bulk layer 402 can be suppressed.

However, it is required that not only the generation of carrier traps is suppressed, but also the number of carriers caught in such carrier traps is reduced. For this reason, in the present invention, the wavelengths of the light for exposure and/or the light for discharge are set shorter than 650 nm, and preferably shorter than 600 nm. When such a light of short wavelengths is used, the absorption factor of this light of short wavelengths in the bulk layer 402 is large, and almost of the irradiated light is absorbed in the portion near the surface, namely, the second layer region 404. Consequently, carriers generated by light just move to the surface from the shallow portion in the second layer region 404 where they are produced, and the distance of movement of carriers is short. Accordingly, even if carrier traps are formed in the bulk layer 402, the number of carriers caught in carrier traps is reduced, and the number of carriers released again in the next charging is decreased. Accordingly, unevenness of charging can be eliminated, and a current Id flowing into the drum in charging can be made small.

Figure 3:
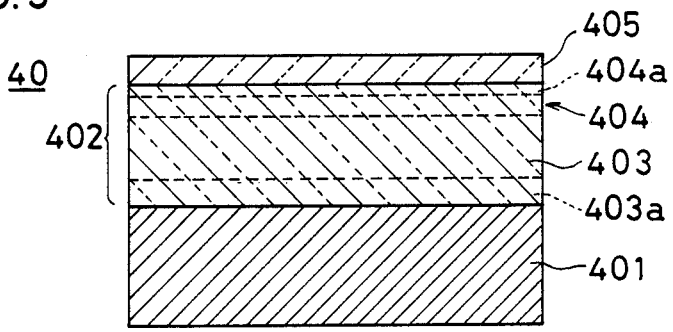
FIG. 3 is a schematic view showing another example of a photosensitive member can be employed in the present invention.
Figure 4:
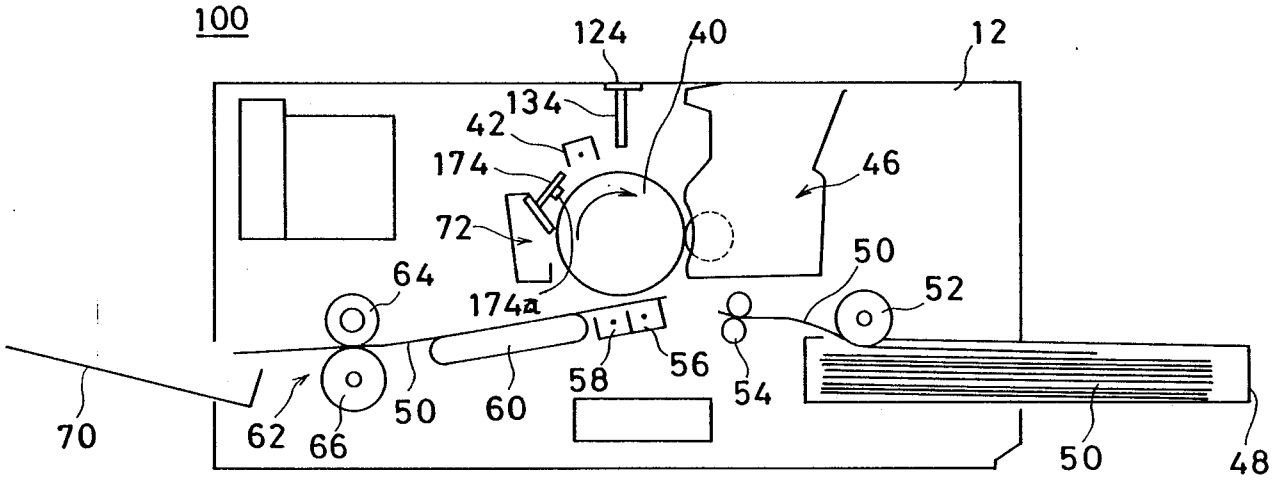
FIG. 4 is an illustrative structure view showing another embodiment in accordance with the present invention.

FIG. 3 is a schematic view showing another example of the photosensitive drum employed in the present invention. In this embodiment, a surface layer region 404*a* is formed in the second layer region 404 in the bulk layer 402 constituting the photosensitive drum 40. Oxygen and boron are doped in this surface layer region 404*a* like the first layer region 403. Specifically, oxygen of 0.1–40 atomic % and boron of $1\times10^{-6}$–1.0 atomic % are added. Then, the film thickness of this surface layer region 404*a* is 0.01–10 μm, and preferably 0.1–1.0 μm.

By forming the surface layer region 404*a* as described above, the resistance in the second layer region 404 becomes large, and movement of surface charges in the lateral direction is suppressed, and thereby the so-called "unstationary image" defect is improved. To be detailed, neither oxygen nor boron is added virtually in the second layer region 404 of FIG. 2 embodiment. Accordingly, the resistance is small, and therefore the surface charges move not only in the direction of thickness of bulk but also in the lateral direction, and resultingly the "unstationary image" defect takes place. On the other hand, in FIG. 3 embodiment, such a movement in the lateral direction of the surface charges is prevented by the surface layer region 404*a* having a relatively high resistance in the second layer region 404, and resultingly the "unstationary image" defect is prevented effectively.

In FIG. 1 embodiment, a halogen lamp and a fuse lamp are used for the light source for exposure 24 and the light source for discharge 74 respectively, and of the lights emitted therefrom, the component of long wavelengths is cut through the cut filters 38 and 76, and only the light of wavelengths shorter than 650 nm or 600 nm are irradiated onto the photosensitive drum 40. However, for such a light source for exposure and/or light source for discharge, other lamps, for example, the tungsten lamp, and the mercury lamp can be utilized in the same number.

Furthermore, in addition to the lamps as described above, a light emitting diode and fluorescent glow lamp can be utilized for the light source for exposure and/or the light source for discharge. In the case of utilizing the light emitting diode, the LED of orange, yellow, green or blue color is used. The green LED is used most practically in the present stage. The green LED has a peak wavelength of 565 nm, and can meet the requirement even if no cut filter is used that the wavelengths of light are to be shorter than 650 nm.

FIG. 6 is an illustrative structure view showing an LED printer as another embodiment in accordance with the present invention. Since the LED printer also has nearly the same configuration as that of the electrophotographic copying machine as shown in FIG. 1 here the same reference number as those of FIG. 1 are put, and thereby detailed description thereon is omitted.

An LED printer 100 comprises a main unit 12, and an LED array 124 as a light source for exposure is fixed on the top surface of this main unit 12, and a short focal lens array 134 is installed in a manner that it hangs down from this LED array 124 and the tip thereof faces the top of the photosensitive drum 40. In this embodiment, a green LED having a peak wavelength of 565 nm is used for LED elements constituting the LED array 124.

An eraser 174 is installed upstream from the charging corotron 42 and adjacent thereto, and the green LED is used likewise for this eraser 174.

When the light intensity is insufficient by such a green LED alone, a light source comprising a weak intensity of light of long wavelengths may be used together.

Meanwhile, in the above-described embodiment, oxygen and boron are not doped virtually in the second layer region 403. However, in this second layer region, oxygen and boron may be added so as to have the concentration thereof become smaller toward the surface from the first layer region, becoming zero virtually at the surface thereof.

Also, in the above-described embodiment, elements in the group III are used as dopants. However, if a reverse-polarity charging mechanism is used, such dopants may be elements in the group V of the periodic table.

Although the present invention has been described and illustrated in detail, it is clearly understood that the same is by way of illustration and example only and it not to be taken by way of limitation, the spirit and scope of the present invention being limited only by the terms of the appended claims.

What is claimed is:

1. An electrostatic recording apparatus comprising:

a photosensitive member which includes a support and a bulk layer composed of an amorphorous material which is formed on the support, wherein a first layer region is formed at the support side in the bulk layer, a second layer region is formed at the surface side therein, said first layer region containing silicon atoms as base material and hydrogen of 0.01-40 atomic %, oxygen, carbon or nitrogen of 0.01-40 atomic % and an element in the group III or V of the periodic table of $5\times10^{-6}$–1.0 atomic %, and said second layer region containing silicon atoms as base material and hydrogen of 0.01-40 atomic % and not being doped virtually with an element in the group III or V of the periodic table, charging means for uniformly charging said photosensitive member, a first light source mounted for exposure to said photosensitive member to form an image after charging said photosensitive member by said charging means, and a second light source mounted for discharging said photosensitive member to eliminate charges remaining on said photosensitive member immediately before charging said photosensitive member by said charging means, the wavelengths of light from said first and second light sources being shorter than 650 nm, respectively.

2. An electrostatic recording apparatus in accordance with claim 1, wherein the wavelengths of said light are shorter than 600 nm.

3. An electrostatic recording apparatus in accordance with claim 1, wherein said second light source comprises a lamp which generates light of wavelengths longer than 650 nm, and a cut filter for cutting off the region of wavelengths longer than 650 nm of the light from the lamp.

4. An electrostatic recording apparatus in accordance with claim 3, wherein said lamp comprises any of an LED, halogen lamp, fluorescent lamp, tungsten lamp, fuse lamp and mercury lamp.

5. An electrostatic recording apparatus in accordance with claim 1, wherein said second light source comprises an LED which emits light of wavelengths shorter than 650 nm.

6. An electrostatic recording apparatus in accordance with claim 5, wherein said second light source comprises an LED of green or blue color.

7. An electrostatic recording apparatus in accordance with claim 1, wherein said first light source comprises a lamp which generates light of wavelengths longer than 650 nm, and a cut filter for cutting off the region of wavelengths longer than 650 nm of the light from the lamp.

8. An electrostatic recording apparatus in accordance with claim 7, wherein said lamp comprises any of a halogen lamp, fluorescent lamp, tungsten lamp, fuse lamp or mercury lamp.

9. An electrostatic recording apparatus in accordance with claim 7, wherein said light source for exposure comprises an LED of wavelengths shorter than 650 nm.

10. An electrostatic recording apparatus in accordance with claim 1, wherein said LED comprises an LED of green or blue color.

11. An electrostatic recording apparatus in accordance with claim 1, wherein the thickness of said surface layer region is 0.01–10 μm.

12. An electrostatic recording apparatus in accordance with claim 11, wherein the thickness of said surface layer region is 0.1–1.0 μm.

13. An electrostatic recording apparatus in accordance with claim 1, wherein the thickness of said first layer region is 1–50 μm, and the thickness of said second layer region is 0.05–20 μm.

14. An electrostatic recording apparatus in accordance with claim 13, wherein the thickness of said first layer region is 3–40 μm, and the thickness of said second layer region is 0.5–10 μm.

15. An electrostatic recording apparatus in accordance with claim 14, wherein the thickness of said first layer region is 5–30 μm and the thickness of said second layer region is 1–5 μm.

16. An electrostatic recording apparatus in accordance with claim 1, wherein said photosensitive member comprises a surface protecting layer formed on said bulk layer.

17. An electrostatic recording apparatus in accordance with claim 16, wherein said surface protecting layer contains an amorphous silicon as a base material, and oxygen, carbon or nitrogen is doped thereinto.

18. An electrostatic recording apparatus, comprising:

a photosensitive member including a support and a bulk layer composed of an amorphous material, and a first light source mounted for exposure to said photosensitive member to form a latent image on the surface thereof and a second light source mounted for discharging charges on said photosensitive member, the wavelength of light from these light sources is shorter than 650 nm.

19. An electrostatic recording apparatus in accordance with claim 18, wherein said photosensitive member includes a first layer region formed at the support side in the bulk layer, and a second layer region formed at the surface side in the bulk layer, said first layer region containing silicon atoms as base material, hydrogen of 0.01–40 atomic %, oxygen, carbon or nitrogen of 0.01–40 atomic % and an element in the group III or V of the periodic table of $5\times10^{-6}$–1.0 atomic %, and the second layer region containing silicon atoms as base material and hydrogen of 0.01–40 atomic % and not being doped virtually with an element in the group III or V of the periodic table.

20. An electrostatic recording apparatus comprising:

a photosensitive member which includes a support and a bulk layer composed of an amorphorous material which is formed on the support, wherein a first layer region is formed at the support side in the bulk layer, a second layer region is formed at the surface side therein, said first layer region containing silicon atoms as base material, hydrogen of 0.01–40 atomic %, oxygen, carbon or nitrogen of 0.01–40 atomic % and an element in the group III or V of the periodic table of $5\times10^{-6}$–1.0 atomic %, and the second layer region containing silicon atoms as base material and hydrogen of 0.01–40 atomic % and not being doped virtually with an element in the group III or V of the periodic table, and a surface layer region formed in said second layer region of said bulk layer of said photosensitive member, said surface layer region containing silicon atoms as base material, oxygen, carbon or nitrogen of 0.1–40 atomic % and hydrogen of 0.1–40 atomic % and an element of $1\times10^{-6}$–1.0 atomic % in the group III or V of periodic table, a first light source mounted for exposure to said photosensitive member to form an image and a second light source mounted for discharging said photosensitive member, the wavelengths of light from these light sources are shorter than 650 nm.

21. An electrostatic recording apparatus in accordance with claim 19, wherein the thickness of said first layer region is 1.50 μm, and the thickness of said second layer region is 0.05–20 μm.

22. An electrostatic recording apparatus in accordance with claim 20, wherein the thickness of said first layer region is 1–50 μm, and the thickness of said second layer region is 0.05–20 μm.

23. An electrostatic recording apparatus in accordance with claim 19, which further comprises a surface protecting layer formed on said bulk layer.

24. An electrostatic recording apparatus in accordance with claim 20, which further comprises a surface protecting layer formed on said bulk layer.

25. An electrostatic recording apparatus in accordance with claim 18, wherein said second light source comprises a lamp which generates light of wavelengths longer than 650 nm, and a cut filter for cutting off the region of wavelengths longer than 650 nm of the light from the lamp.

26. An electrostatic recording apparatus in accordance with claim 20, wherein said second light source comprises a lamp which generates light of wavelengths longer than 650 nm, and a cut filter for cutting off the region of wavelengths longer than 650 nm of the light from the lamp.

27. An electrostatic recording apparatus in accordance with claim 25, wherein said lamp comprises any of a halogen lamp, fluorescent lamp, tungsten lamp, fuse lamp and mercury lamp.

28. An electrostatic recording apparatus in accordance with claim 26, wherein said lamp comprises any of a halogen lamp, fluorescent lamp, tungsten lamp, fuse lamp and mercury lamp.

29. An electrostatic recording apparatus in accordance with claim 20, wherein the thickness of said surface layer region is 0.01–10 μm.

30. An electrostatic recording apparatus in accordance with claim 29, wherein the thickness of said surface layer region is 0.1–1.0 μm.

31. An electrostatic recording apparatus in accordance with claim 20, wherein the thickness of said first layer region is 1–50 μm, and the thickness of said second layer region is 0.05–20 μm.

32. An electrostatic recording apparatus in accordance with claim 31, wherein the thickness of said first layer region is 3–40 μm, and the thickness of said second region is 0.5–10 μm.

33. An electrostatic recording apparatus in accordance with claim 32, wherein the thickness of said first layer region is 5–30 μm and the thickness of said second layer region is 1–5 μm.

* * * * *